US006545583B1

(12) United States Patent
Palmer

(10) Patent No.: US 6,545,583 B1
(45) Date of Patent: Apr. 8, 2003

(54) SEALING A LEAD FROM A CONFINED CAVITY OF AN APPARATUS SUCH AS A SOLENOID

(75) Inventor: Clarence Keith Palmer, Rockford, IL (US)

(73) Assignee: PNC, Inc., Rockford, IL (US)

( * ) Notice: Subject to any disclaimer, the term of this patent is extended or adjusted under 35 U.S.C. 154(b) by 0 days.

(21) Appl. No.: 10/173,889

(22) Filed: Jun. 18, 2002

(51) Int. Cl.[7] ..... H01B 17/26

(52) U.S. Cl. ..... 336/192; 174/152 G; 174/153 G; 174/65 G; 174/151; 174/167

(58) Field of Search ..... 336/192; 174/152 G, 174/153 G, 65 G, 152 R, 151, 167

(56) References Cited

U.S. PATENT DOCUMENTS

| | | | |
|---|---|---|---|
| 4,122,433 | A | 10/1978 | McNeel |
| 4,226,432 | A | 10/1980 | Nakamizo |
| 4,567,544 | A | 1/1986 | Ronemus et al. |
| 4,701,999 | A | 10/1987 | Palmer |
| 5,173,053 | A | 12/1992 | Swanson et al. |
| 5,226,220 | A | 7/1993 | Gevas et al. |
| 5,504,973 | A | 4/1996 | Kameyama |
| 5,533,249 | A | 7/1996 | Wakeman |
| 5,557,073 | A | 9/1996 | Truesdale, Jr. et al. |
| 5,589,808 | A | 12/1996 | Clark et al. |
| 5,710,535 | A | 1/1998 | Goloff |
| 5,920,035 | A | 7/1999 | Haney et al. |
| 6,087,590 | A | 7/2000 | Meinherz et al. |
| 6,175,083 | B1 | 1/2001 | Palmer et al. |

FOREIGN PATENT DOCUMENTS

| | | |
|---|---|---|
| EP | 0662696 | 7/1995 |

*Primary Examiner*—Ramon M. Barrera
(74) *Attorney, Agent, or Firm*—Leydig, Voit & Mayer, Ltd.

(57) ABSTRACT

The sealing mechanism comprises a cap and a grommet for sealing an electrical lead extended from a coil overmold or a closed cavity. The grommet provides a first seal against the electrical lead and a second seal against a mounting section around the electrical lead. The cap is snap-fit onto the mounting portion for the lead through engagement between corresponding snap structures on the cap and mounting portion. The grommet comprises a skirt section and a cover section. The skirt section forms a radial seal against the mounting portion while the cover section seals against the leads.

20 Claims, 6 Drawing Sheets

60
60
42
62
62
56
66
58
70
74
70
72
72
68
78
78
50
50
52
44
52
48
28
30
46
10
36
38
54
34
76
16
12

SEALING A LEAD FROM A CONFINED CAVITY OF AN APPARATUS SUCH AS A SOLENOID

FIELD OF THE INVENTION

This invention relates generally to an arrangement for sealing a lead from a confined cavity of an apparatus and more particularly to an externally mounted mechanical sealing arrangement.

BACKGROUND OF THE INVENTION

Various attempts have been set forth to seal lead wires or pins extending from a coil that is encapsulated within a plastic overmold. In some of these attempts, a cavity is formed within the overmold and the lead wires or pins from the coil extend into the cavity and a rubber grommet is disposed within the cavity. The lead wires extend through holes within the grommet and are sealed by a compressive force exerted on the outer circumference of the grommet. Many times, in these attempts, it is difficult to mold the plastic material around the leads extending therethrough.

Many other arrangements are known for connecting leads to coils having overmold disposed around the coil. In these other arrangements, the leads that extend from the coil through the overmold may not be totally sealed from the outside atmosphere when being subjected to varying temperature. It is well known that when a coil is produced that small voids are present after the winding is placed on the bobbin and the plastic overmold material is injected around the coil. During an increase in temperature, the pressure of the air within these voids expands thus producing an increase in pressure therein which, if not properly sealed, escapes around the leads that pass through the overmold. Likewise, as the temperature decreases, a pressure less than atmospheric is created within the voids. Consequently, if the leads are not properly sealed, air is drawn into the voids from the outside atmosphere. If the coil is being used in an environment containing contaminants, the contaminants are drawn into the voids and cause premature failure of the coil. Therefore, it is desirable to provide a positive seal so that contaminants cannot be drawn into the coil or sealed cavity. Likewise, it is desirable to provide such a seal arrangement to seal around other types of leads to protect sensitive components disposed in an otherwise sealed cavity from outside contaminants.

One solution to these problems and complications is disclosed in Palmer et al., U.S. Pat. No. 6,175,083, the entire disclosure of which is hereby incorporated by reference. As set forth therein, a disc shaped grommet member is retained in sealing relationship with lead wires by the combination of a separate cap member and a separate collar. The collar is integrally melted and molded to both the mounting portion of the coil overmold and to the cap member. By integrally melting and molding the collar over the cap and mounting portion of the overmold, there is no possibility for water to enter the enclosed cavity between the cap and the mounting portion. This design has met the standards of different Original Equipment Manufacturers (OEMs which require a dunk test in a water solution comprised of water, detergent and/or salt (each OEM uses different times, temperatures and depths for the dunk test) to ensure that no water reaches the wire coil cavity (e.g. the wire coil cavity is hermetically sealed).

While the design of '083 patent has provided a solution and has met with substantial commercial success, it does require a second molding operation to integrally mold and melt the collar over the cap member and mounting portion of the coil overmold. This is undesirable as it has required further cost and labor associated with this second molding operation.

BRIEF SUMMARY OF THE INVENTION

In light of the above, and according to one aspect of the present invention, it is an objective of the present invention to provide a seal mechanism design for an electrical lead extending from a closed cavity (e.g. an overmold of a wire coil) that utilizes a less expensive method and apparatus to adequately seal the closed cavity from water and/or other contaminants in the external environment.

According to an aspect of the present invention, it is an objective of the present invention to eliminate a second molding operation in the assembly of solenoid assemblies such as those set forth in the background section above.

In that regard, it is a further object of the present invention to provide a less expensive way to provide a solenoid assembly that successfully passes dunk tests as described in the background section above.

According to another aspect of the present invention, it is another objective of the present invention to provide a more effective sealing grommet design for sealing an electrical lead extending from a closed cavity (e.g. an overmold of a wire coil).

In accordance with these and other aims and objectives, the present invention is directed at a new sealing mechanism comprising a cap and a grommet for an electrical lead extending from a coil overmold or closed cavity. The grommet provides a first seal against the electrical lead and a second seal against a mounting section around the electrical lead. The cap is retained on the mounting portion for the lead through engagement between corresponding retaining structures on the cap and the mounting portion.

According to one aspect of the present invention, the grommet comprising a skirt section and a cover section. The skirt section forms a radial seal against the mounting portion while the cover section seals against the electrical leads.

According to another aspect of the present invention, the cap mechanically snaps onto the mounting portion. The cap serves to secure the grommet to the mounting portion.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
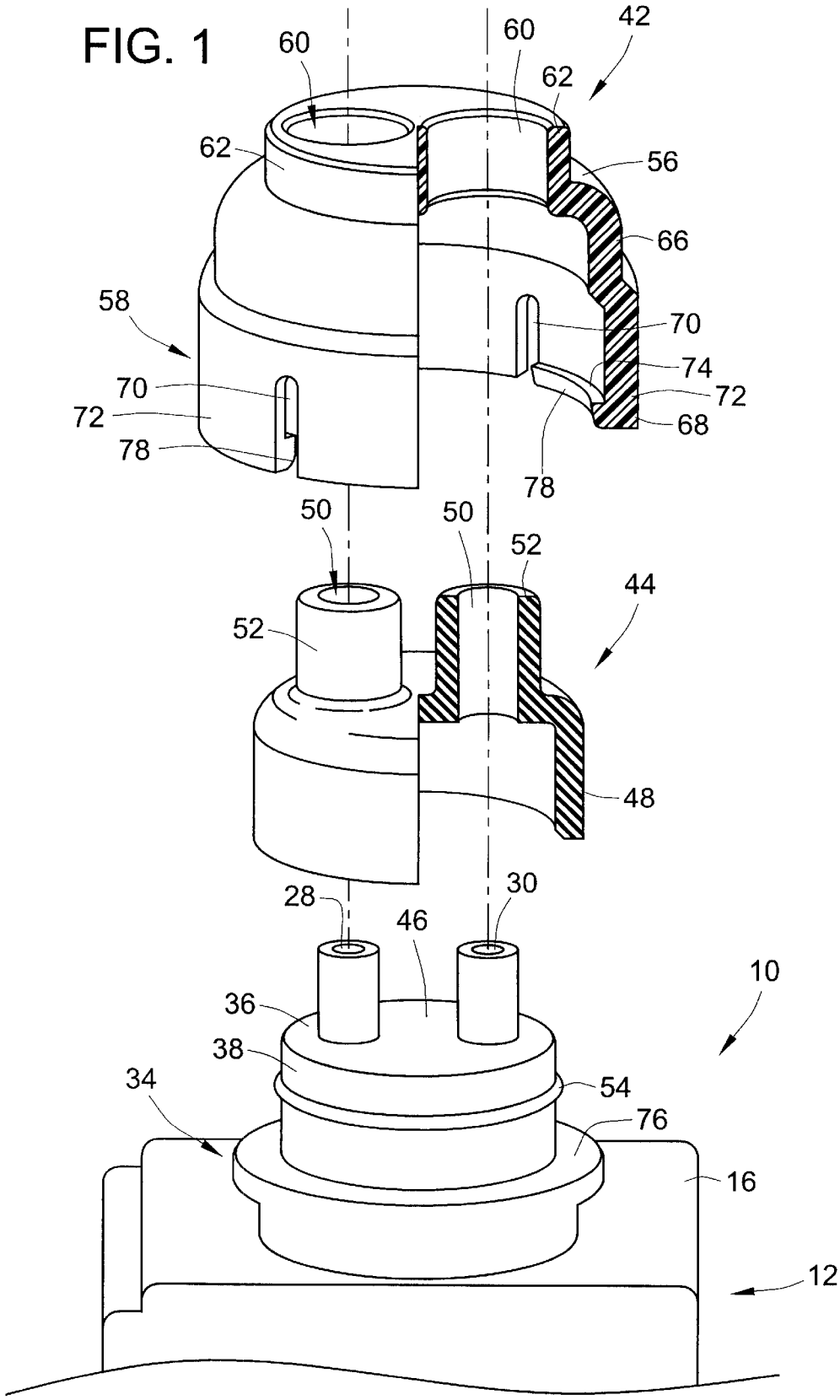
FIG. 1 an exploded partially cross-sectioned, perspective assembly view of a solenoid assembly incorporating a seal mechanism for electrical leads according to a preferred embodiment of the present invention.
Figure 3:
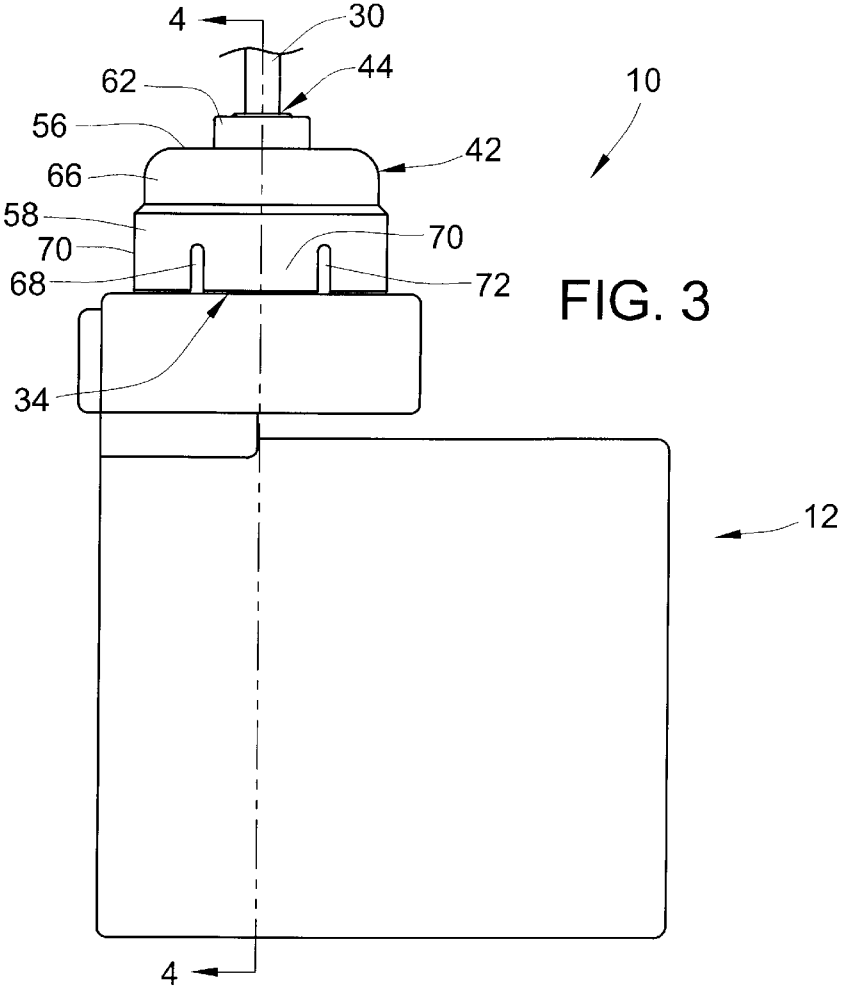
FIGS. 2 and 3 are top side and front side views of the assembled solenoid assembly referenced in FIG. 1.
Figure 2:
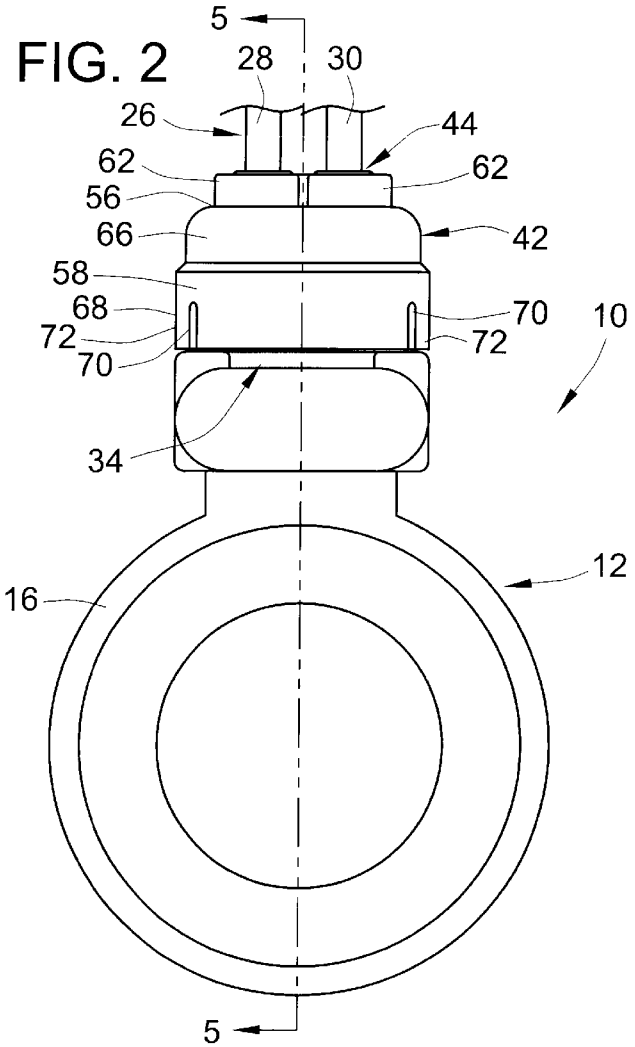
Figure 5:
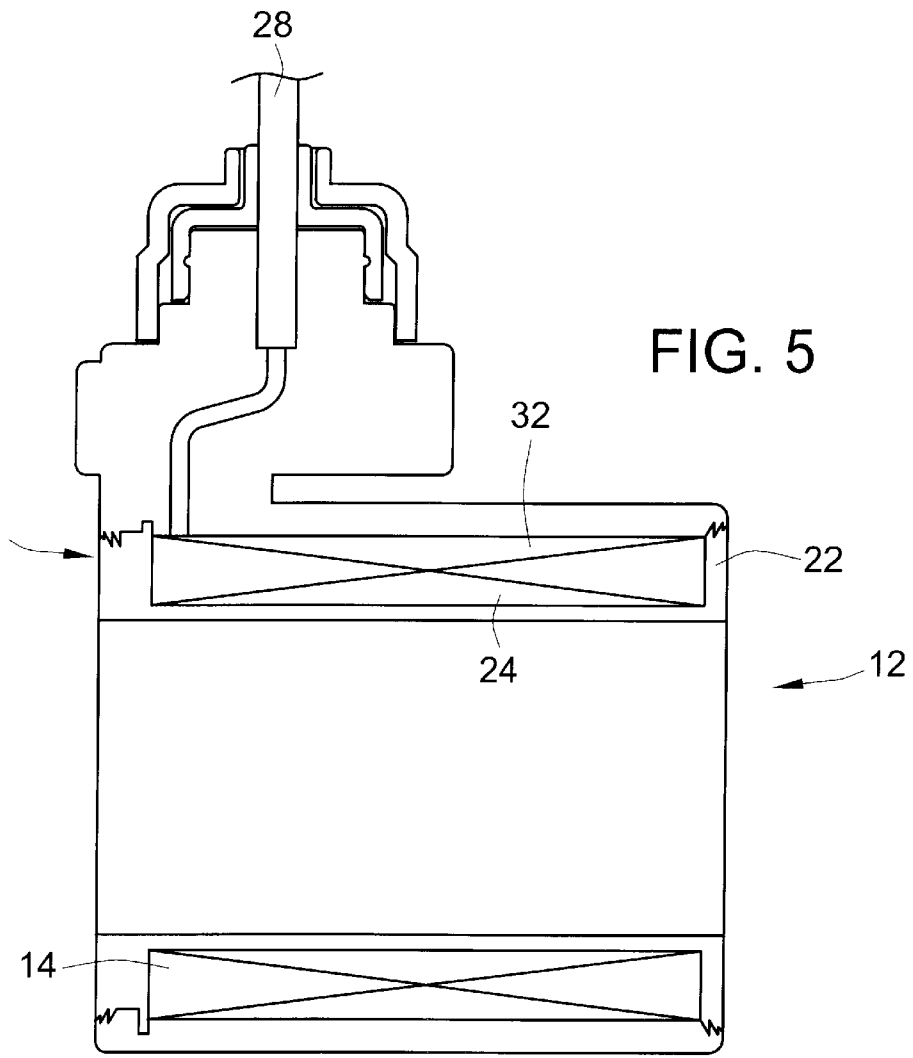
FIG. 5 is a cross section of FIG. 2 about line 5—5.
Figure 4:
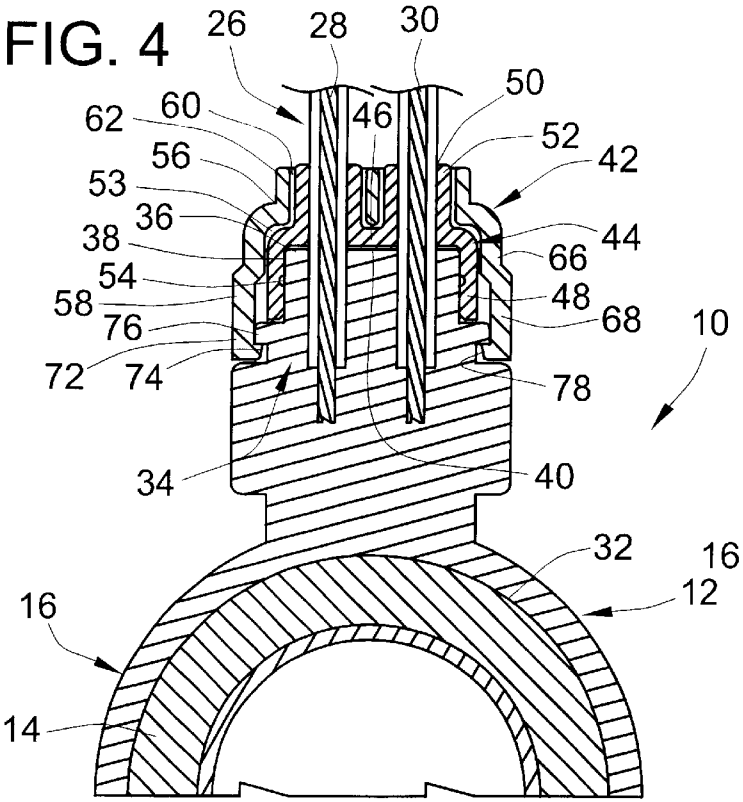
FIG. 4 is a cross section of FIG. 3 about line 4—4.
Figure 6:
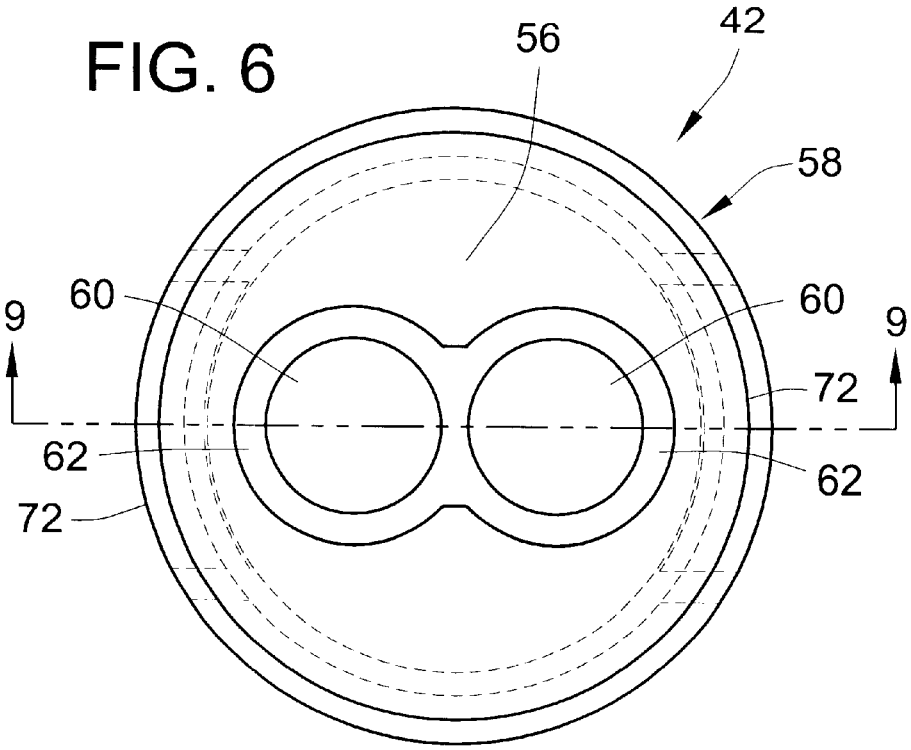
FIGS. 6–8 are top, side, and front views of the cap of the solenoid assembly shown in the prior Figures.
Figure 7:
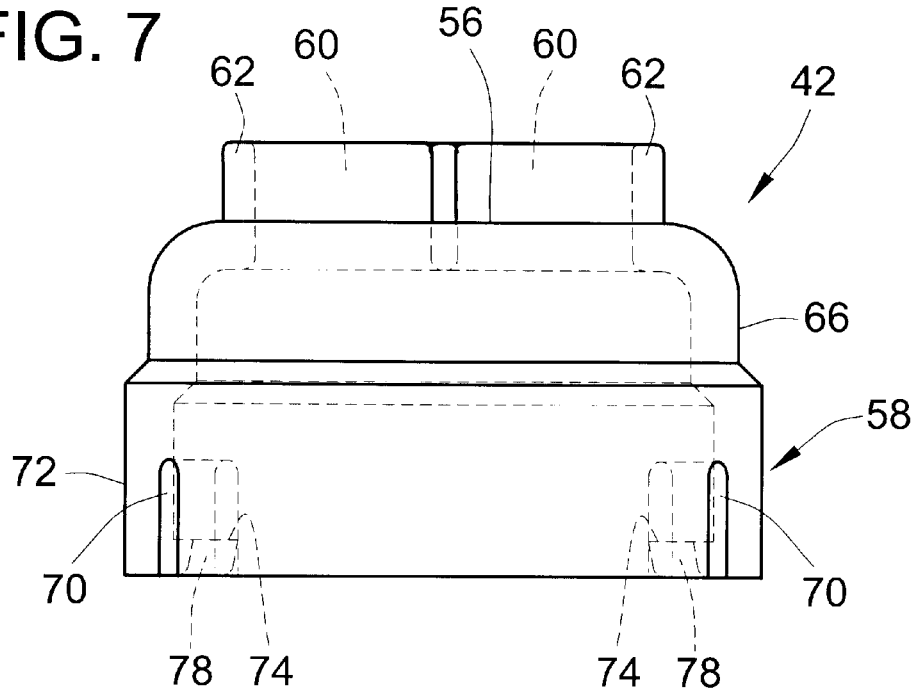
Figure 8:
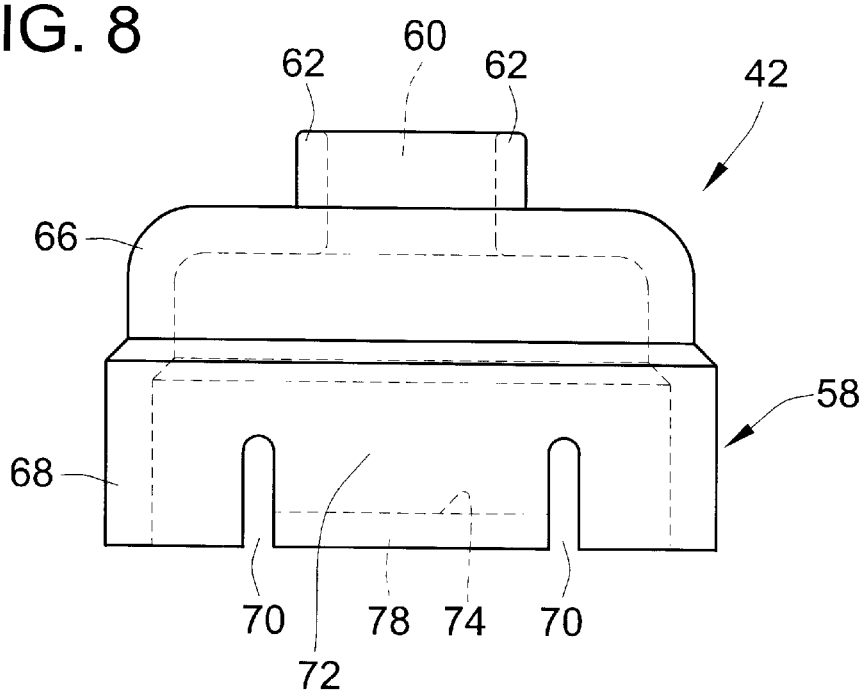
Figure 9:
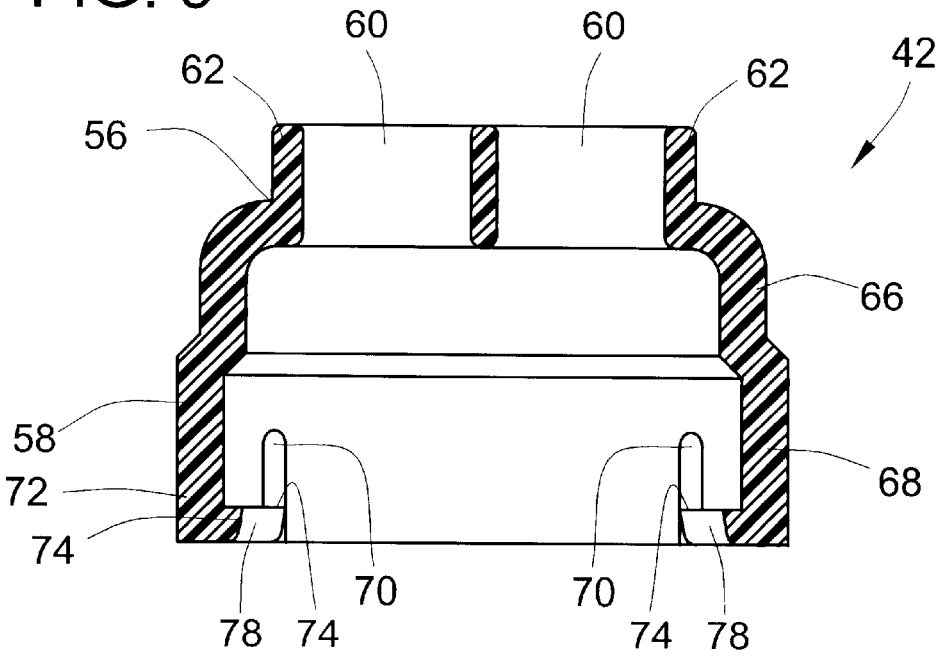
FIG. 9 is a cross section of FIG. 6 about line 9—9.
Figure 10:
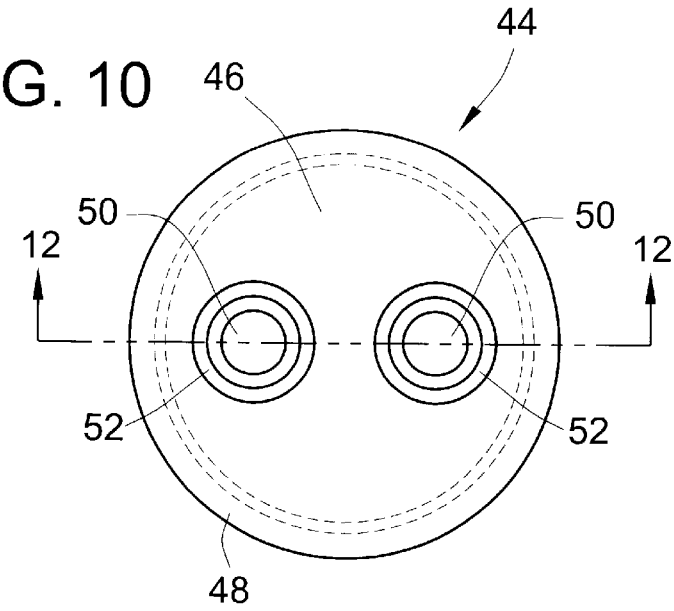
FIGS. 10 and 11 are top and side views of the grommet of the solenoid assembly, shown in FIGS. 1, 4 and 5.
Figure 11:
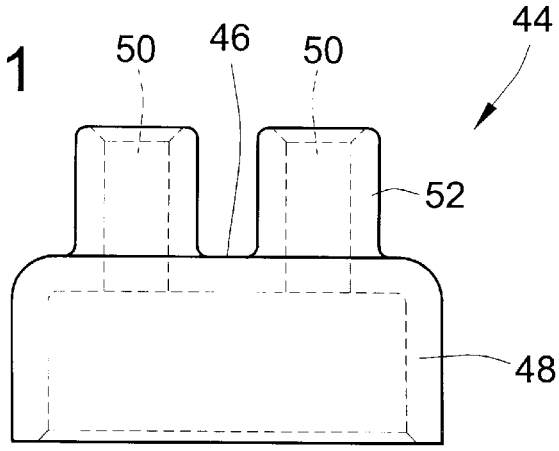
Figure 12:
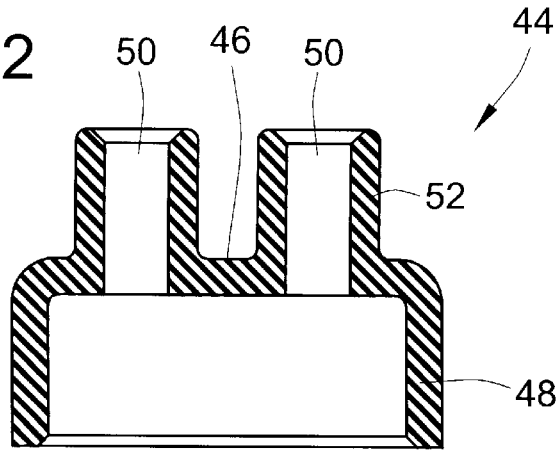
FIG. 12 is a cross section of FIG. 10 about line 12—12.

Referring to the drawings and more particularly to FIGS. 1–3, an apparatus shown in the form of a solenoid 10 having a wire coil assembly 12 is illustrated. It is recognized that the apparatus could be many things other than a solenoid 10. For example, the apparatus could be a transmission housing, a sensor housing, or any other types of structures having a closed cavity with an electrical lead extending therefrom through the wall of the apparatus.

The coil assembly 12 of the solenoid 10 includes a wire coil 14 that is encapsulated by a plastic overmold 16 to protect the coil from contamination. The wire coil 14 is made up of a bobbin 22 and windings 24 in a well known manner. The overmold 16 is integrally molded and melted together with the bobbin 22 of the to encapsulate the wire coil windings 24. An electrical lead 26 (e.g. one or more wire leads or pins) is connected to and extends from the windings 24 through the plastic overmold 16. The portion of the electrical lead 26 extending from and generally adjacent to the overmold 16 has a predetermined cross-sectional shape and size.

In the subject embodiment, the electrical lead 26 includes first and second flexible lead wires 28, 30 having an insulating material disposed around the wires in a well known manner. It is also known to fill any space between the wire and the insulating material with a substance, such as silicone, in order to ensure that air cannot pass therethrough. The coil 14 is located in a closed cavity 32 formed by the overmold 16 and the bobbin 22. The lead wires 28, 30 extend from a mounting portion 34 that is formed into the overmold 16. The mounting portion 34 projects outwardly from the wire coil 14 and includes a raised face or plateau 36 and a generally cylindrical sidewall 38.

In accordance with the present invention, the disclosed embodiment includes a novel sealing mechanism at the mounting portion 34 to seal off the interface area 40 between the mounting portion 34 and the lead wires 28, 30 from water and other external contaminants. The sealing mechanism comprises a cap 42 and a grommet 44. According to the preferred method of assembly, the grommet 44 is first slid and fitted onto the mounting portion 34. Then, the cap 42 is pressed on or otherwise mechanically retained on to the mounting portion 34 over the grommet 44. The cap 42 generally prevents removal or dislodging of the grommet 44.

In the disclosed embodiment, the grommet 44 is made of resilient elastomeric material such as silicone-rubber or other similar rubber/rubber-like material, and includes a disc shaped cover section 46 and a skirt section 48. The skirt section 48 is generally cylindrical and depends downwardly from the cover section 46. The cover section 46 seats against the plateau 36 of the mounting portion 34 while the skirt section 48 encompasses the sidewall 38 of the mounting portion 34. The lead wires 28, 30 project through holes 50 in the cover section 46. The grommet 44 may also include bosses 52 depending upwardly from cover section 46 that surround the lead wires 28, 30.

The grommet 44 fits tightly on the mounting portion 34 and tightly over the lead wires 28, 30 to hermetically seal lead wire/overmold interface area 40. Specifically, the holes 50 in the grommets 44 are of a smaller diameter than the diameter of the lead wires 28, 30 such that grommet 44 is in constant contact and biased against the wires (via the resilient nature of the elastomeric material) to form a hermetic ring seal around each of the lead wires 28, 30. The skirt section 48 includes an inner diameter that is less than an outer diameter the mounting portion sidewall 38, at least along a portion to form a hermetic radial seal between the mounting portion 34 and the grommet 44. In the disclosed embodiment, this is achieved through an annular rib 54 projecting radially outward from sidewall 38 (or alternatively a rib projecting inward from the inner periphery of the skirt section of the grommet). The rib 54 is of a larger diameter than the inner diameter of the skirt section 48 such that the rib 54 engages the skirt section 48 along a thin ring about the sidewall 38. The resilient nature of the grommet 44 keeps the grommet 44 in contact and biased against the mounting portion 34 to form a hermetic radial seal around the rib 54.

With the grommet 44 installed on the mounting portion 34 of the plastic overmold 16 and without the cap 42, the interface area 40 between the lead wires 28, 30 and the overmold 16 is hermetically sealed. When the grommet 44 is installed on the mounting portion 34, the grommet still can be easily dislodged or removed. To ensure that the grommet 44 is properly retained and secured on the mounting portion 34, a plastic cap 42 is provided. However, the cap 42 does not necessarily need to apply a compressive force to the grommet 44 to achieve the first and second seals provided by the grommet 44. The stretching in the grommet 44 when the grommet 44 is installed on the wires 28, 30 and over the mounting portion 34 accomplishes the first and second seals alone. The cap 42 may be sized sufficiently larger than the grommet 44 such that a small clearance gap 53 may exist between the grommet 44 and the cap 42 when installed on the mounting portion 34.

In the preferred embodiment, the plastic cap 42 is snap-fit onto the mounting portion 34 over the grommet 44. However, it will be appreciated that other mechanical retention arrangements between for the cap 42 and the mounting portion 34 could also be utilized. The plastic cap 42 generally includes a generally planar cover portion 56 and a skirt portion 58 depending downwardly from the cover portion 56. The cover portion 56 includes two holes 60 that align coaxially with the two holes 50 in the grommet 44. The bosses 52 and the wires 28, 30 project through the holes 60 in the cover portion 56. The cover portion 56 may also include bosses 62 about the holes 60 to surround and protect the projecting bosses 52 extending from the grommet 44.

The skirt portion 58 is generally cylindrical and includes a smaller diameter segment 66 and a larger diameter segment 68. The smaller diameter segment 66 surrounds, protects and/or retains the skirt section 48 of the grommet 44. The larger diameter segment 68 is made somewhat resilient by design through axial slots 70. The slots 70 divide part of the larger diameter segment 68 of the skirt portion 58 into prongs 72 that are adapted to flex inwardly and outwardly. The prongs 72 include radially inwardly projecting locking tabs 74. The locking tabs 74 axially engage a flange or shoulder 76 that projects radially outwardly from the mounting portion 34.

As shown, the tabs 74 are of a smaller diameter than the flange or shoulder 76. To allow for installation, the prongs 72 of the skirt portion 58 flex radially outward during installation to allow the tabs 74 to snap past the flange or shoulder 76. To facilitate spreading of the prongs 72, the bottom end of the skirt portion 58 may include a chamfered or rounded cam surface 78 (a similar cam surface may also be provided alternatively or additionally on the flange or shoulder 76). When the cap 42 is being axially pressed on the mounting portion 34 and the cam surface 78 engages the flange or shoulder 76, the cam surface 78 translates axial force into radial force to spread the skirt prongs 72 apart to allow the locking tabs 74 to slide past the shoulder 76. Once the locking tabs 74 axially clear the shoulder 76, the tabs 74 snap radially back inward to the relaxed position and engage the underside of the flange 76 to secure and lock the cap 42 on the mounting portion 34, and thereby protect and retain the grommet 44.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A solenoid comprising:

a wire coil having a pair of leads;

an overmold encapsulating the wire coil, the overmold defining a mounting portion, the leads being molded into the mounting portion of the overmold, the mounting portion defining a first retainer structure;

an elastomeric grommet arranged on the mounting portion and forming a first seal against the mounting portion, the first seal surrounding the leads, the leads extending through the grommet, the grommet forming a second seal against the leads; and a cap having a cover portion and a skirt portion, the cover portion defining holes receiving the leads therethrough, the skirt portion having a second retainer structure engaging the first retainer structure securing the cap on the mounting portion with the elastomeric grommet therebetween.

2. The solenoid of claim 1 wherein, the mounting portion comprises a plateau with an outer peripheral sidewall, the lead extending through the plateau, the elastomeric grommet comprising a cover section and skirt section, the cover section between the cover portion of the cap and the plateau, the skirt section between the skirt portion of the cap and the outer peripheral sidewall.

3. The solenoid of claim 2 wherein the first seal is a radial seal between the skirt section of the elastomeric grommet and the sidewall of the mounting portion.

4. The solenoid of claim 3 wherein the sidewall of the mounting portion is annular and defines a radially outward projecting rib engaging the skirt section, the elastomeric grommet having an inner diameter in the skirt section less than an outer of the radially outward projecting rib such that the radial seal is provided between the skirt section and the radially outward projecting rib.

5. The solenoid of claim 2 wherein the grommet includes bosses projecting from the cover portion, the bosses defining openings engaging the leads to form the second seal.

6. The solenoid of claim 1 wherein an interface between the cap and the mounting portion is free of hermetic sealing, wherein fluid seepage between the cap and the mounting portion is sealed from an intersection between the overmold and the leads by virtue of the first seal of the elastomeric grommet.

7. The solenoid of claim 1 wherein the cap is snapped onto the mounting portion.

8. The solenoid of claim 7 wherein the skirt portion of the cap includes prongs having radially inward locking tabs, the locking tabs engaging a radially outward projecting shoulder on the mounting portion to secure the cap to the mounting portion.

9. The solenoid of claim 8 wherein the prongs include a cam means for stretching the prongs radially outwardly to allow the locking tabs to snap past the radially outward projecting shoulder.

10. The solenoid of claim 1 wherein the first and second seals are hermetic wherein water is prevented from reaching the intersection of the leads and the overmold when the solenoid is submersed in water.

11. A sealing mechanism for sealing a lead extending from a closed cavity of an apparatus, the apparatus comprising a mounting portion with the lead being molded into the mounting portion, the mounting portion defining a first retainer structure, the sealing mechanism comprising:

an elastomeric grommet arranged on the mounting portion and forming a first seal against the mounting portion, the first seal surrounding the lead, the lead extending through the grommet, the grommet forming a second seal against the leads; and a cap having a cover portion and a skirt portion, the cover portion defining a hole receiving the lead therethrough, the skirt portion having a second retainer structure engaging the first retainer structure securing the cap on the mounting portion with the elastomeric grommet therebetween.

12. The sealing mechanism of claim 11 wherein, the mounting portion comprises a plateau with an outer peripheral sidewall, the lead extending through the plateau, the elastomeric grommet comprising a cover section and skirt section, the cover section between the cover portion of the cap and the plateau, the skirt section between the skirt portion of the cap and the outer peripheral sidewall.

13. The sealing mechanism of claim 12 wherein the first seal is a radial seal between the skirt section of the elastomeric grommet and the sidewall of the mounting portion.

14. The sealing mechanism of claim 13 wherein the sidewall of the mounting portion is annular and defines a radially outward projecting rib engaging the skirt section, the elastomeric grommet having an inner diameter in the skirt section less than an outer of the radially outward projecting rib such that the radial seal is provided between the skirt section and the radially outward projecting rib.

15. The sealing mechanism of claim 12 wherein the grommet includes at least one boss projecting from the cover portion, the at least one boss defining an opening engaging the lead to form the second seal.

16. The sealing mechanism of claim 11 wherein an interface between the cap and the mounting portion is free of hermetic sealing, wherein fluid seepage between the cap and the mounting portion is sealed from an intersection between the mounting portion and the lead by virtue of the first seal of the elastomeric grommet.

17. The sealing mechanism of claim 11 wherein the cap is snapped onto the mounting portion.

18. The sealing mechanism of claim 11 wherein the skirt portion of the cap includes prongs having radially inward locking tabs, the locking tabs engaging a radially outward projecting shoulder on the mounting portion to secure the cap to the mounting portion.

19. The sealing mechanism of claim 18 wherein the prongs include a cam means for stretching the prongs radially outwardly to allow the locking tabs to snap past the radially outward projecting shoulder.

20. The sealing mechanism of claim 11 wherein the first and second seals are hermetic wherein water is prevented from reaching the intersection of the lead and the mounting portion when the solenoid is submersed in water.

* * * * *